US006477792B2

(12) United States Patent
Sartor

(10) Patent No.: US 6,477,792 B2
(45) Date of Patent: Nov. 12, 2002

(54) METHOD OF MANUFACTURING A COMPOSITE VAPOR-PERMEABLE INSOLE AND INSOLE THUS OBTAINED

(75) Inventor: Adriano Sartor, Montebelluna (IT)

(73) Assignee: Stonefly S.p.A., Casella d'asolo (IT)

( * ) Notice: Subject to any disclaimer, the term of this patent is extended or adjusted under 35 U.S.C. 154(b) by 0 days.

(21) Appl. No.: 09/785,264

(22) Filed: Feb. 20, 2001

(65) Prior Publication Data

US 2001/0016991 A1 Aug. 30, 2001

(30) Foreign Application Priority Data

Feb. 28, 2000 (EP) ..... 00830140

(51) Int. Cl.[7] ..... A43B 13/38; A43B 23/00; A43B 7/06; A43B 19/00; A43B 21/32

(52) U.S. Cl. ..... 36/44; 36/28; 36/30 R; 36/71; 36/37; 36/3 B

(58) Field of Search ..... 36/28, 27, 29, 36/30 R, 44, 71, 35 R, 37, 35 B, 3 B, 3 R

(56) References Cited

U.S. PATENT DOCUMENTS 1,920,112 A * 7/1933 Shaft ..... 36/28
2,055,574 A * 9/1936 Hartl ..... 36/28
3,859,740 A * 1/1975 Kemp ..... 36/71
4,494,321 A * 1/1985 Lawlor ..... 36/29
4,577,417 A * 3/1986 Cole ..... 36/28
5,435,078 A * 7/1995 Pyle ..... 36/28
5,588,226 A * 12/1996 Schenkel ..... 36/3 B
5,678,328 A * 10/1997 Schmidt et al. ..... 36/28
5,787,609 A * 8/1998 Wu ..... 36/28
6,138,383 A * 10/2000 Steinke et al. ..... 36/44
2001/0003875 A1 * 6/2001 Moretti ..... 36/3 B

FOREIGN PATENT DOCUMENTS

EP 0399332 A1 * 11/1990 ..... A43B/13/20

* cited by examiner

*Primary Examiner*—Anthony D. Stashick
(74) *Attorney, Agent, or Firm*—Browdy and Neimark

(57) ABSTRACT

A method of manufacturing a vapor-permeable composite insole, comprising the steps of gluing at least one pad of vapor-permeable textile material to a respective work area of a first layer of flexible material, and applying a second layer of relatively soft material to area or areas of the first layer, not affected by the pad or pads. The method comprises also the step of obtaining at least one through opening at the or each work area of the first layer. The step of gluing at least one pad to a respective work area of the first layer is realized on at least a work area located at the ball or sole portion of said insole. A composite insole obtainable with such a method.

8 Claims, 4 Drawing Sheets

METHOD OF MANUFACTURING A COMPOSITE VAPOR-PERMEABLE INSOLE AND INSOLE THUS OBTAINED

BACKGROUND OF THE INVENTION

The present invention relates to a method of manufacturing a composite insole which allows transpiration to occur and to an insole thus obtained.

The present state of the art includes various solutions for manufacturing shoe accessories, in particular insoles which combine an aesthetic quality result with healthy hygienic conditions and comfort for user's foot.

More particularly, the use of new fabrics of synthetic material as a substitute for natural materials, e.g. cork, to manufacture inner soles, plantars or insoles has yielded important results in terms of improving hygienic and health conditions of the foot, in particular owing to their water-repellence and vapor-permeability properties.

However, there still remains the drawback that many synthetic materials used in said fabrics can cause unpleasant sensations, e.g. irritations or allergies, affecting feet having particularly sensitive skin, for which natural materials would be more suitable.

SUMMARY OF THE INVENTION

The main object of the present invention is to provide a method which makes it possible to manufacture a composite and vapor-permeable insole, thereby associating aesthetic and qualitative properties of a natural material with the transpiration advantages of synthetic material fabrics.

Another object of the present invention is to provide a method which makes it possible to manufacture an insole having vapor-permeable properties confined to localized and preset regions.

Another object of the present invention is to provide an insole which allows transpiration to take place at a vapor-permeable portion localized in preset regions of said insole, preferably where foot perspiration is higher.

These and other objects which will become better apparent hereinafter are achieved, according to a first aspect of the present invention, by a method of manufacturing a vapor-permeable composite insole as described in the accompanying claims 1–5.

According to another aspect of the present invention, there is provided a composite insole suitable for allowing transpiration as described in the accompanying claims 6–16.

BRIEF DESCRIPTION OF THE DRAWINGS

Further aspects and advantages of the present invention will become better apparent from the following detailed description of some currently preferred embodiments thereof, given by way of non-limitative example only, with reference to the accompanying drawings, in which.

DESCRIPTION OF THE PREFERRED EMBODIMENT

Figure 3:
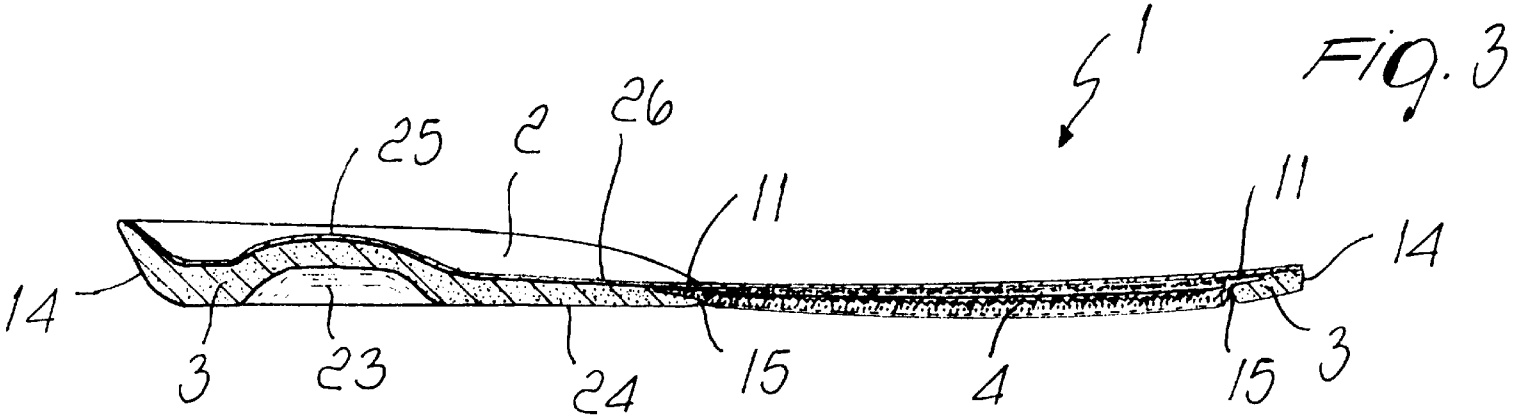
FIG. 3 is a cross-sectional view of the insole, taken along the line III—III of FIG. 2.
Figure 1:
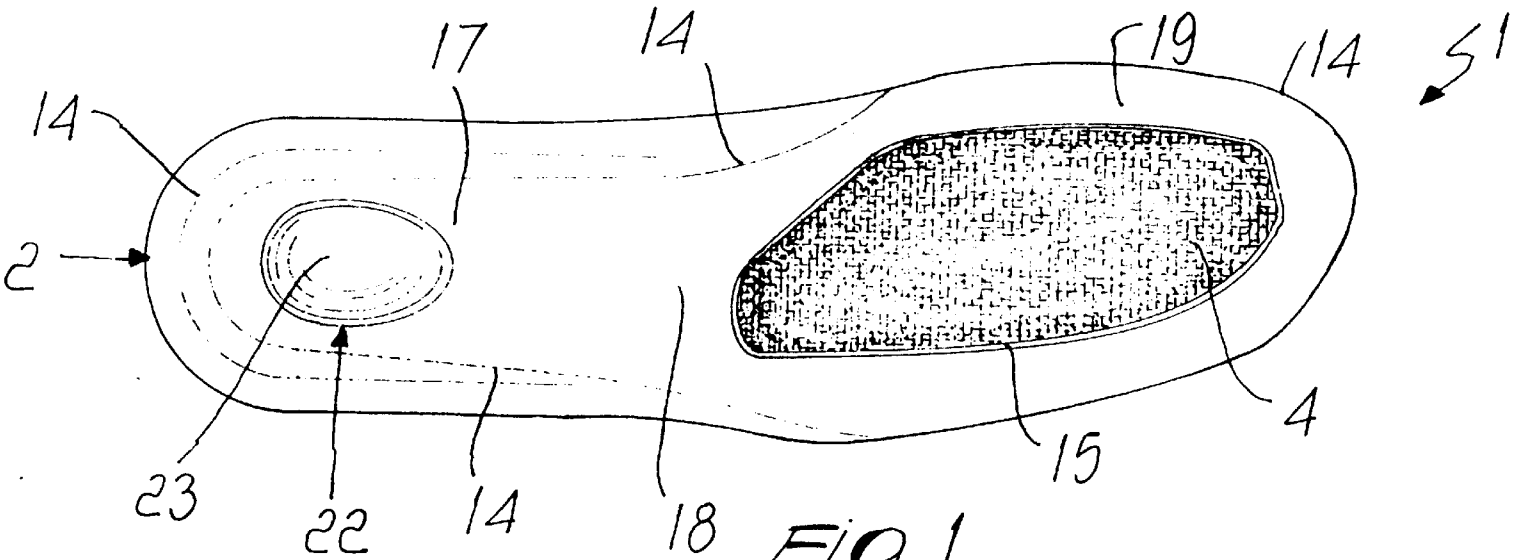
FIG. 1 is a plan view of the lower surface of an insole according to the invention.
Figure 5:
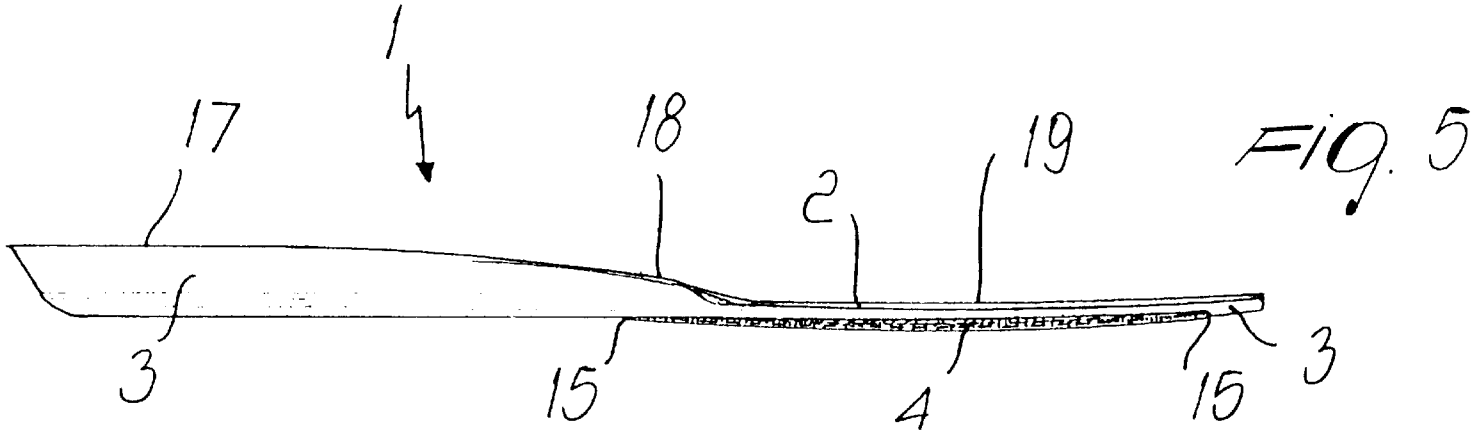
FIG. 5 shows a lateral elevation view of the insole of FIG. 1.

With reference to the above Figures, the reference numeral 1 designates an insole according to the invention, which can comprise a first layer 2, preferably made of flexible material, a second layer 3, made of relatively soft material, and a pad 4 made of vapor-permeable textile material.

The first layer 2 made of flexible material can be constituted by leather and/or imitation leather; layer 3 made of relatively soft material can be constituted by a synthetic material which is foamed to a greater or less extent depending upon softness requirements, e.g. PVC (polyvinyl chloride), polyurethane or EVA (ethyl vinyl acetate), whereas pad 4 made of vapor-permeable textile material can be constituted by a commercially available fabric known per se and constituted by woven fibers of a synthetic material, e.g. a polymer of inert plastics, such as polyester, polyamide, polypropylene or the like.

Figure 4:
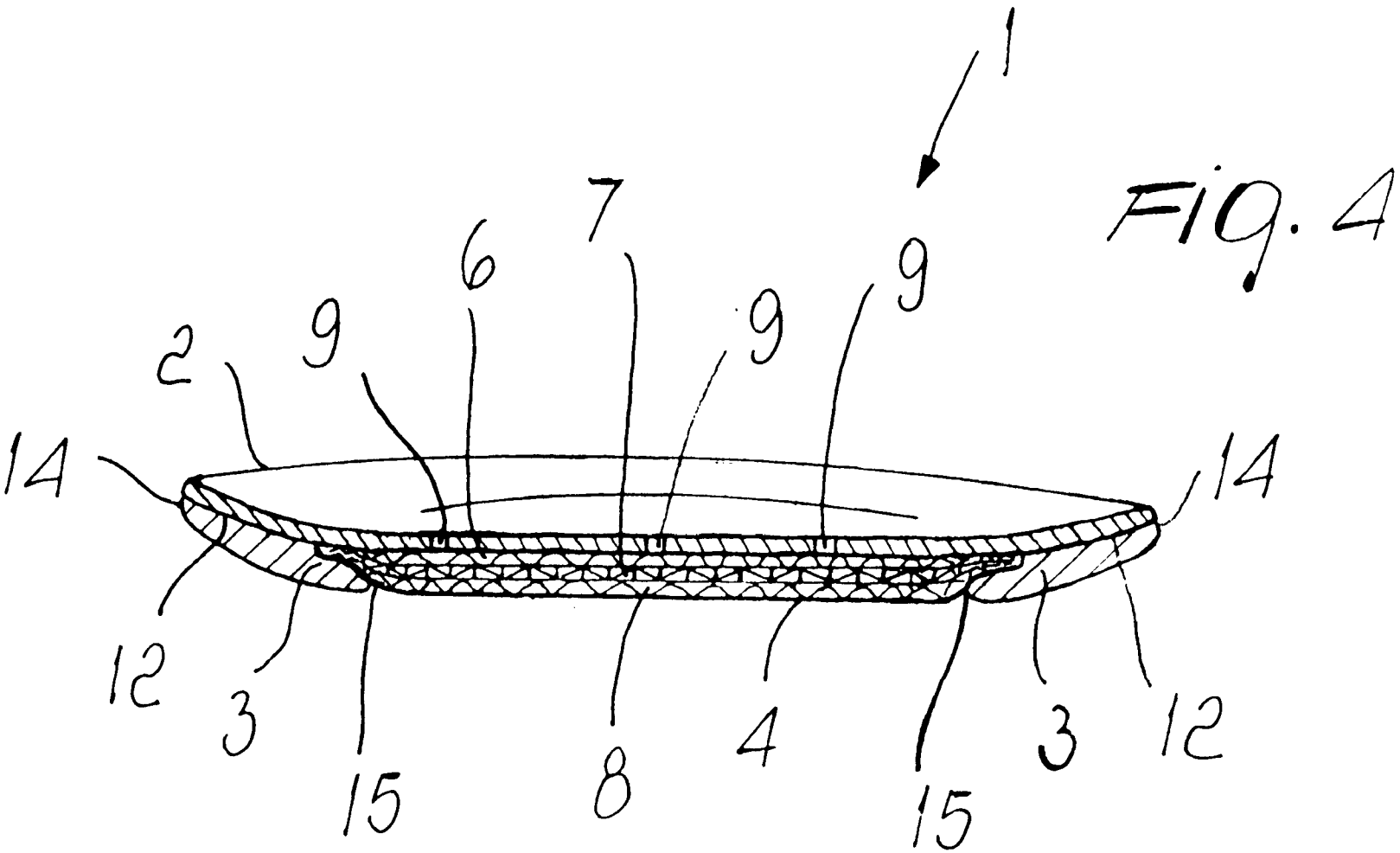
FIG. 4 shows an enlarged-scale cross-sectional view of the insole, taken along the line IV—IV of FIG. 2.

As more clearly shown in FIG. 4, pad 4 can advantageously comprise three layers 6, 7 and 8 which form a textile net-like insert structure, i.e. a so-called "mattress" structure, in which the intermediate layer 7 is particularly yieldable by having a specific density lower than that of the two outer layers 6 and 8 so as to enhance the resilience properties of pad 4 and improve comfort of the insole 1.

The method of manufacturing the vapor-permeable insole 1 comprises, first of all, gluing, by means of an adhesive 11, a pad 4, made of vapor-permeable textile material, to the lower surface 12 at a respective work area of the layer 2 of flexible material.

Figure 2:
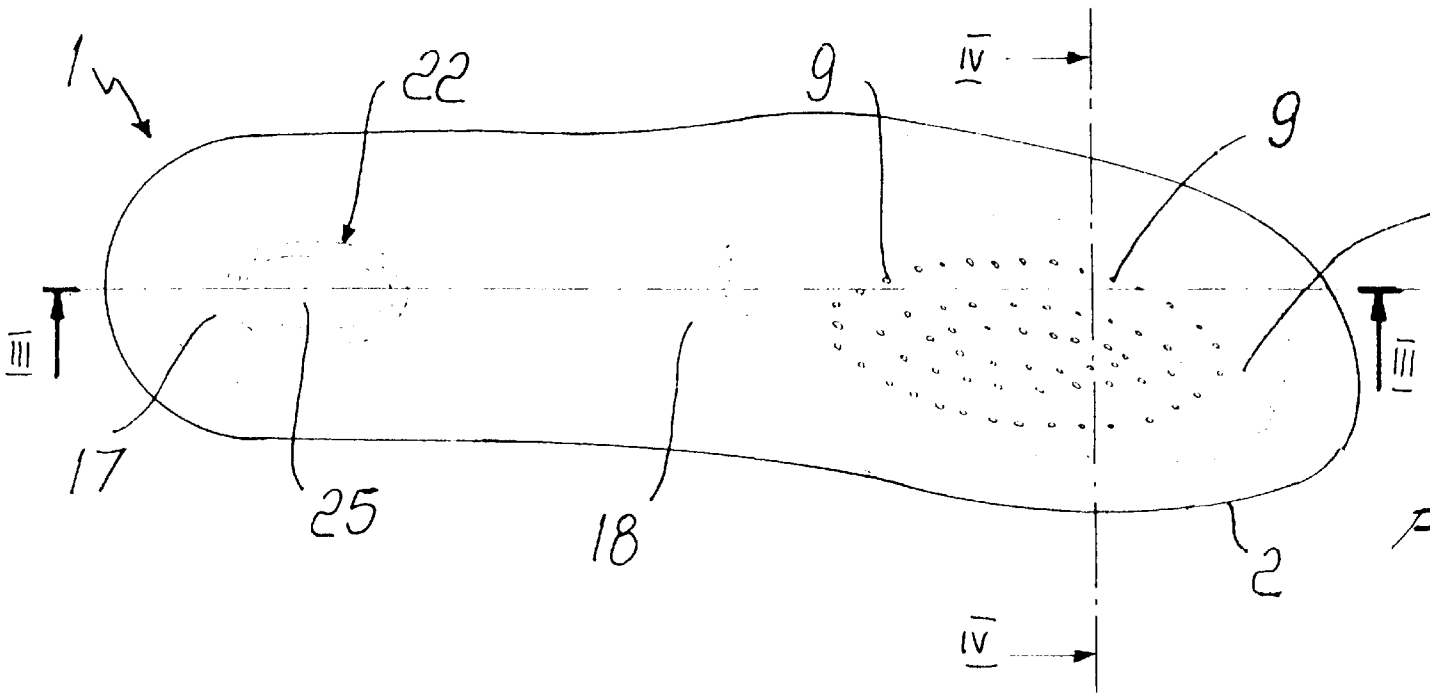
FIG. 2 is a plan view of the upper surface of the insole of FIG. 1.

Preferably, a plurality of through holes 9, as shown in FIG. 2, are formed at each work area of the layer 2, generally before the gluing operation, said holes being designed to be located, in use, at a respective vapor-permeable pad 4.

Advantageously, the through holes 9, which can have different dimensions from one another, are located at the ball or middle portion 19 of the insole 1, or in regions where user's foot rests frequently and where inevitably greater is foot perspiration.

The layer 2 of flexible material and the vapor-permeable pad, coupled and glued as described above, undergo injection-molding to obtain layer 3 of synthetic material. The molding operation thus delimits layer 3 of synthetic material within a preset border 14 and outside an internal area which is delimited by a border 15, is located at the vapor-permeable pad 4 and is slightly smaller than said pad, so as to partly overlap it along its entire border.

Injection-molding thus allows the synthetic material 3 to be uniformly distributed around the vapor-permeable pad 4, which is held so as to permanently adhere to the layer 2 of flexible material owing to the adhesive properties of the synthetic material, thereby generating a sort of "bonding" which ensures that the insole 1 is watertight.

By the injection-molding process it is also possible to obtain a layer 3 of synthetic material which has a suitable thickness distribution on the foot resting surface, whereby forming a relatively soft anatomic support for the insole 1. The portion 17 of the insole 1, which acts as a supporting surface for the user's heel, can advantageously be thicker than the intermediate portion 18 and the portion corresponding to the ball portion 19 of the insole, and preferably has a stud 22 which delimits a recess 23 at the lower surface 24 of the insole 1 and a raised area 25 on the upper surface 26, on which the user's foot rests, the recess 23 and the raised area 25 being well radiused for joining their respective adjacent surfaces.

The method according to the present invention is susceptible of numerous modifications and variations within the scope defined by the appended claims. The above method may, of course, comprise the application, to the insole 1, of a vapor-permeable pad 4 also at the portion 17 thereof, where the heel of the foot rests (this solution is not shown in the said Figures).

In order to allow transpiration through the entire thickness of the insole 1, a plurality of holes 9 are then formed in the portion 17 of the layer 2 of flexible material and subsequently a pad 4 of vapor-permeable fabric is applied and glued to the lower surface 12 of the layer 2 of flexible material.

Since portion 17 of the insole 1 has a relatively high thickness, owing to the anatomic shape of the layer 3 of relatively soft material, it is preferable to adopt a vapor-permeable portion whose thickness is great enough to avoid formation of regions of discontinuity on the foot resting surface.

With the above-described method, therefore, there is obtained a composite insole, such as that shown in the above Figures, which is suitable for achieving the above specified objects, thereby ensuring in particular a suitable and localized vapor-permeable effect without affecting comfort and aesthetic appearance of the shoe to which it is applied.

Figure 6:
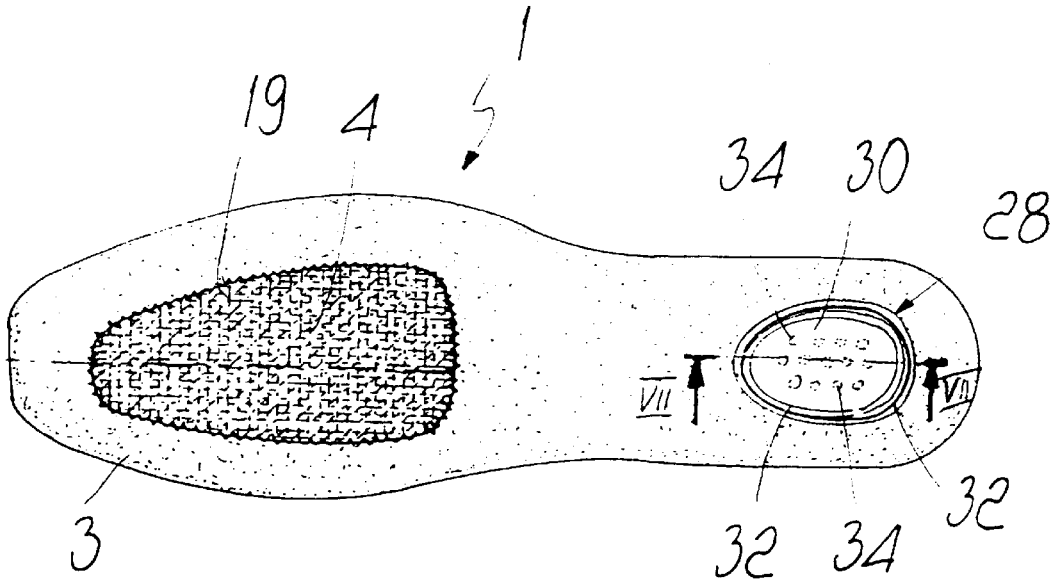
FIG. 6 is a plan view of another embodiment of the insole of FIG. 1.
Figure 7:
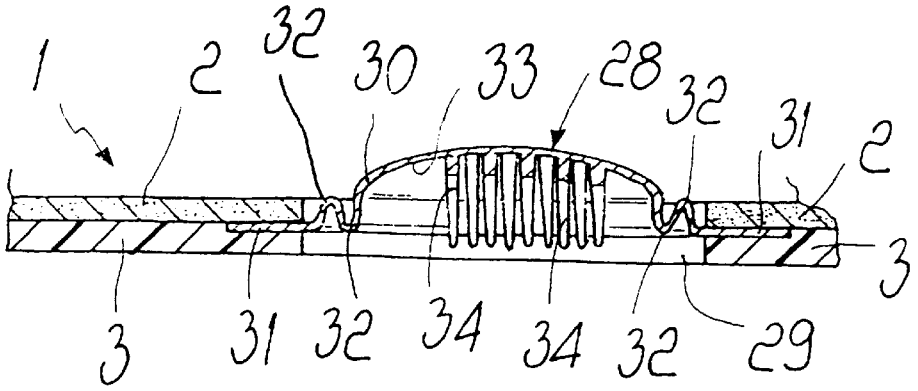
FIG. 7 shows an enlarged-scale partial cross-sectional view, taken along the line VII—VII of FIG. 6.

Another embodiment of insole 1 is shown in FIGS. 6 and 7 and relates to an insole 1 provided with a pad 4 made of vapor-permeable material, which is arranged at the portion 19 of layer 2, which is formed with holes 9 and an insert 28 made of flexible material extending over or through opening 29 formed beforehand in the layer 2 of flexible material and not affected by the injection-molding of the layer 3 of relatively soft material.

Preferably, insert 28 comprises a membrane 30 having a peripheral border 31 held between layer 2 and layer 3 of the insole 1 and arranged to pass, in use, from a rest position, in which it is in relief with respect to layer 2, as shown in FIG. 7, to a working position, in which it is compressed by the heel of the user's foot. The membrane 30 can have two concentric ridges 32 which extend inside the border 31 and are suitable for increasing its rigidity and acting, in use, as a return means so as to facilitate the passage of the membrane 30 from its working position to its rest position.

To withstand relatively intense pressure applied by the heel to the membrane 30 and to increase, in use, the effectiveness of the insert 28, the membrane 30 also has, at its lower surface 33, a plurality of pins 34 whose longitudinal extension is preferably perpendicular to both layers 2 and 3.

The insole 1 provided with the insert 28 as described above can thus be inserted in a shoe provided with a specific forced air circulation device and help improving the effectiveness of the processes of air sucking in, and discharging from, the inside of the shoe.

The material and the dimensions may be various according to requirements.

What is claimed is:

1. A composite insole suitable for allowing transpiration comprising a first layer of flexible material which has at least one work area, at least one pad made of vapor-permeable material which is applied to said first layer at said work area, and a second layer made of relatively soft material which is permanently applied substantially to a side of said first layer at an area or areas not affected by the pad, the insole further having a through opening at least at one region which is not affected by said pad, and comprising at least one insert made of flexible material, positioned in said through opening, the insert comprising at least one membrane having a border which is coupled between said first and second layers, said membrane being arranged to alternatively take, in use, a rest position, in which it delimits an upper surface convex toward the outside and in relief with respect to said first layer and a lower surface concave toward the outside and recessed with respect to said second layer, and a working position, in which it is substantially within said opening, said membrane comprising at least one resilient yieldable accordion-like peripheral portion and return means for increasing the effectiveness of said insert, when said membrane is in its working position, and facilitating the return of said membrane from said working position to said rest position.

2. A composite insole according to claim 1 wherein said second layer is obtained by injection-molding on said first layer.

3. A composite insole according to claim 1 wherein said second layer is distributed around said pad of vapor-permeable material, partially interpenetrating the border of said pad, and providing a permanent hermetic bonding between said pad and said first layer.

4. A composite insole according claim 1 wherein said pad of vapor-permeable material is constituted by a fabric made of synthetic material in multiple layers.

5. A composite insole according to claim 1 wherein said first layer is made of leather and/or imitation leather.

6. A composite insole according to claim 1 wherein said second layer is made of a material chosen from the group consisting of PVC (polyvinyl chloride), polyurethane and EVA (ethyl vinyl acetate).

7. A composite insole according to claim 1 comprising, in at least one area not affected by said pad, at least one portion which delimits a concave lower surface on the side of said insole that is constituted by said second layer and a convex upper surface on the other side.

8. A composite insole according to claim 1 wherein said return means comprises a plurality of pins which protrude from said lower surface and are longitudinally elongated transversely to said first and second layers.

* * * * *